US005092013A

United States Patent [19]

Genovese, Jr.

[11] Patent Number: 5,092,013

[45] Date of Patent: Mar. 3, 1992

[54] DISPOSABLE TOILET SEAT WIPE APPARATUS WITH INTERNAL ACTUATION

[76] Inventor: Philip A. Genovese, Jr., 550 Ocean Ave., Apt. 11H, Monmouth Beach, N.J. 07750

[21] Appl. No.: 617,564

[22] Filed: Nov. 26, 1990

Related U.S. Application Data

[63] Continuation-in-part of Ser. No. 519,578, May 7, 1990, abandoned.

[51] Int. Cl.[5] ..... A47L 13/17; B65D 83/00

[52] U.S. Cl. ..... 15/104.94; 4/233; 15/209 R; 15/210 R; 15/212; 118/264; 206/205; 206/361; 206/804; 206/823; 401/130; 401/132; 401/261

[58] Field of Search ..... 15/104.93, 104.94, 209 R, 15/212, 209 D, 214, 210 R, 244.1-244.4; 206/15.2, 38, 38, 205, 233, 361, 581, 804, 812, 823; 221/22, 23, 36, 312 C; 401/132-135, 122, 196, 130, 150, 202, 261, 262, 266, 292; 4/233; 118/264-266

[56] References Cited

U.S. PATENT DOCUMENTS

| | | | |
|---|---|---|---|
| 2,024,218 | 12/1935 | Haas | 15/209 R |
| 2,760,302 | 8/1956 | Cheskin | 15/244.1 X |
| 3,240,326 | 3/1966 | Miller | 4/233 X |
| 3,519,364 | 7/1970 | Truhan | 401/196 X |
| 4,575,891 | 3/1986 | Valente | 15/104.93 |
| 4,601,081 | 7/1986 | Sutton et al. | 15/210 R |
| 4,873,728 | 10/1989 | Bono | 4/233 |
| 4,881,278 | 11/1989 | Farah | 206/361 X |
| 4,884,913 | 12/1989 | Smith et al. | 401/196 |
| 4,998,984 | 3/1991 | McClendon | 206/205 |
| 5,025,524 | 6/1991 | Genovese, Jr. | 15/104.94 |

FOREIGN PATENT DOCUMENTS

| | | | |
|---|---|---|---|
| 2826890 | 1/1980 | Fed. Rep. of Germany | 294/1.1 |

*Primary Examiner*—Philip R. Coe
*Assistant Examiner*—C. Cooley
*Attorney, Agent, or Firm*—Charles I. Brodsky

[57] ABSTRACT

The disposable toilet seat wipe apparatus of this invention includes a pre-moistened, cleansing pad within a carrying container in coupling relationship with a plunger construction extending outwardly from one of the container ends. The opposite end of the container is configured to "blossom" the cleansing pad out of the container as the plunger is actuated inwardly, with the plunger and container then serving as a handle for the apparatus in wiping the seat with the pre-moistened pad as so deployed. A series of protrusions are also provided within the container to prevent the cleansing pad from coming loose from the handle during manipulation of the apparatus.

10 Claims, 1 Drawing Sheet

FIG. 1
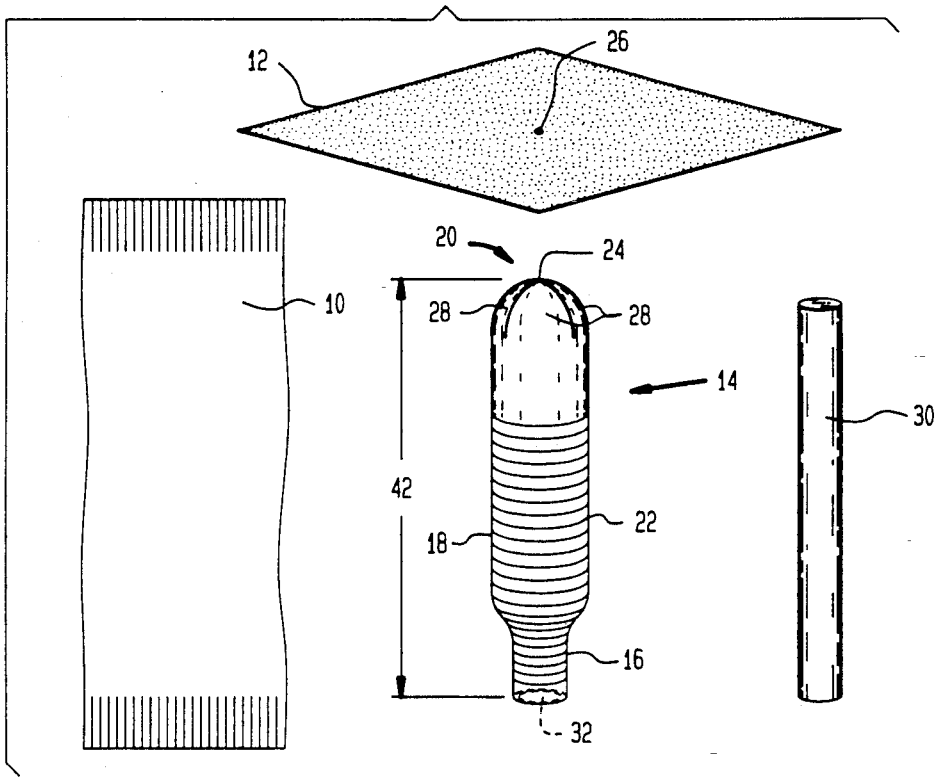
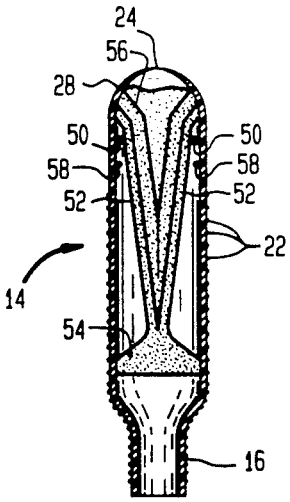
FIG. 3
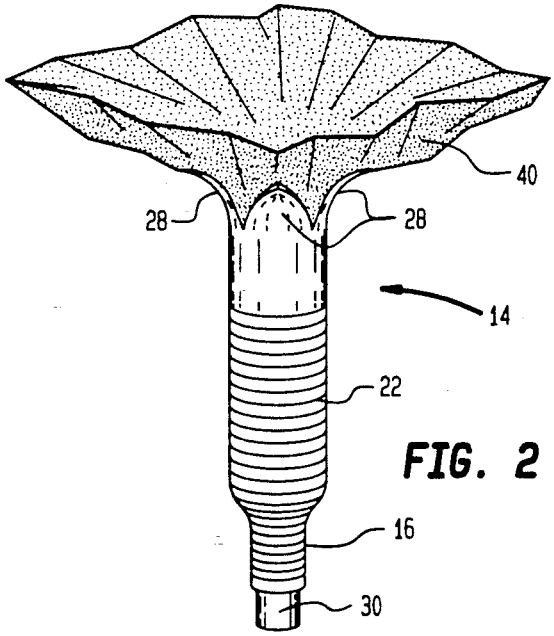
FIG. 2

DISPOSABLE TOILET SEAT WIPE APPARATUS WITH INTERNAL ACTUATION

This is a Continuation-in-Part of application Ser. No. 07/519,578 filed May 7, 1990.

FIELD OF THE INVENTION

The present invention relates to disinfecting cleaning aids, in general, and to disposable apparatus for permitting an individual to disinfect a toilet seat before use, in particular.

BACKGROUND OF THE INVENTION

As is well known and understood, individuals who have the need to use a public restroom are not very desirous of using the toilet seat generally provided. In some areas of the country and of the world, apparatus may be available to provide toilet seat shaped tissue paper covers to be placed over the seat prior to use. Although helpful, those covers are of a basic configuration, and do not always cover the seat area in question, and are not always available because of the cost involved in installation and in maintenance.

As is also well known and appreciated, the process of addressing this problem then typically entails the simple process of tearing various lengths of toilet paper from off the roll in an attempt to correspond to the configuration of the seat. While satisfactory in concept, the carrying out of such plan often suffers, as the laid-out strips of paper do not readily remain in place, but shift in position, both prior to and during use. Of perhaps greater importance, however, is that not all the public restroom facilities offer toilet paper (in rolls), but provide folded, inter-leaved sheets, to then be positioned one adjacent the other on the toilet seat in going around the toilet seat shape. Besides being cumbersome to follow—and difficult to retain the individual sheet sections in position—, this procedure is both time consuming to carry out, and awkward in realization.

As an alternative to the use of such protective devices, others have come forward to suggest that disinfecting cleansing pads be employed, instead. These pads, the arguments go, can be pre-moistened with a germicidal, or other, cleansing agent, can be small enough to be easily carried about, and can be made readily available to wipe the surface of the toilet seat prior to its use. Suggestions abound as to the specific formulation of the antiseptic solution, with or without scenting, with various drying rates, with a variety of shelf lives prior to use, and with various degrees of constructions so as to be decomposable in water, so as to be flushed away with the toilet wastes. Prior art descriptions, for example, suggest that pads made of synthetic fibers are preferable to using natural fibers; others suggest formulations of resins to provide wet strength along with "flushability"; some prior art pronouncements point out the advisability of incorporating alcoholic solutions, mercury zinc cyanide solutions, with, or without, quick-drying characteristics.

However, and as will be seen, except for perhaps cost, there does not appear to be a great deal of difference between individual ones of these suggested alternatives, as would induce an individual to purchase one as compared to the other. And, as will also be seen, one of the major disadvantages in all of these suggested alternatives is that the individual must, of necessity, place his, or her, hand close to the unsanitized toilet seat in utilizing the cleansing pad being offered. Typical of such type of device is the one shown in U.S. Pat. No. 4,575,891, where a 2"×2" pad is described, to have a raisable thumb tab to be grasped in use—as there shown, the tab is of the order of perhaps ½"; and, as will be seen, even the dimensions afforded may not be enough to disinfect the toilet seat in a single pass, but repeated back-and-forth actions would be generally required to sanitize the entire seat surface which may be contacted during use.

SUMMARY OF THE INVENTION

As will become clear hereinafter, the disposable toilet seat wipe apparatus of the invention includes a premoistened cleansing pad within a carrying container to be coupled with a plunger construction extending outwardly from one of the container ends. As will be seen, the container, in a preferred configuration, is constructed of a tube which may be ribbed for griping and strengthening and is accessible to receive the plunger of length comparable to that of the container. In accordance with the preferred embodiment, the opposing end of the container incorporates a plurality of flexible, spaced openings through which the pad is arranged to exit as the plunger is actuated inwardly of the handle. As will be appreciated, the forced deployment of the cleansing pad "blossoms-out" the pad over its configuration in providing the desired wiping area for the toilet seat, but with the pad remaining secured internally of the container by a series of nibs so as prevent the pad from coming loose. With the plunger fully inserted so as to dispense the swab through the opposing end of the container, the container tubing can then be grasped to serve as the handle for the apparatus in wiping the seat with the premoistened pad as so deployed.

As will be appreciated, any type of material can be selected for the cleansing pad, and any type of disinfecting, or germicidal, solution may be employed, as well. In like manner, any materials can be employed for the container or plunger—although preferred constructions might employ plastic compositions for such component parts. As will also be apparent, the entire applicator—i.e., the container with the cleansing pad stored therein, and the plunger can be packaged in any suitable wrapper or envelope, sealed for sanitary protection and impervious to air and moisture before use. Such packaging, in the form of a foil envelope or wrapper, for example, can be flexible and frangible, so as to be easily carried about, or dispensable by vending machine sale at areas adjacent to the public restroom. Once the container, or package, is broken open, the disposable toilet seat wipe apparatus would then be ready for use.

BRIEF DESCRIPTION OF THE DRAWING

These and other features of the present invention will be more clearly understandable from a consideration of the following description, taken in connection with the accompanying drawing, in which:

FIG. 1 illustrates the disposable toilet seat wipe apparatus of a preferred embodiment of the invention in dis-assembled arrangement;

FIGS. 2 and 3 illustrate the manner of deploying the cleansing pad according to the invention.

DETAILED DESCRIPTION OF THE DRAWING

Referring to FIGS. 1-3, the disposable toilet seat wipe apparatus of the invention includes, first of all, any suitable container or package 10—in the nature of a plastic or foil envelope or wrapper, for example—which can be sealed against moisture or air, and for sanitary purposes, and for preventing evaporation of the cleaning solution in the impregnated cleansing pad to be stored therein. Any type of packaging material can be employed as long as these characteristics are satisfied, in carrying out the teachings of the invention.

The cleansing pad is illustrated by the reference numeral 12, and likewise, can be fabricated of any suitable material, pre-moistened with any type of disinfecting, sanitizing, or germicidal solution. Thus, the cleansing pad may comprise such synthetic fibrous materials as polyester, nylon, acetate, or of natural fibers as cotton, wool, etc.—and with the pre-moistening of the pad 12 being of alcoholic solutions, germicidal solutions, detergents, biocidal compositions, etc. all of which can have appreciable shelf-lives, while at the same time, being quick-drying after application.

One form of container particularly attractive with the present invention is shown by the reference numeral 14 as being of a tubular construction with a narrow bottom portion 16, a central mid-section 18 and a rounded top section 20, with the sections 16 and 18 incorporating spaced ridges (or ribs) 22 for ease of grasping. Fabricated of a plastic, for example, the container 14 is provided with a nib 24 centered internally of the container 14 at its upper end 20. Also shown about the end 20 of the container 14, and about the internal nib 24 are a plurality of flexible, openable leaves 28, angularly disposed about the end 20, through which the pad 12 is to "bloom" outwardly under action of the plunger 30, to be described below. In passing, however, it will be appreciated that such plunger is shown at 30, and generally comprises a tube of suitable cross section to enable the insertion of the plunger 30 through the the opening 32 of the container 14 and permit motion upwardly towards the pad 12 to be stored therein.

To use the disposable toilet seat wipe, the envelope or wrapper 10 is opened, the container 14 with the stored pad 12 removed, and the plunger 30 inserted upwardly of the container 14. Continued upward movement of the plunger pushes the sections of the pad 12 upwardly and out through the leaves 28, leaving substantially only the central portion 26 of the pad 12 within the housing, with the pad sections 12 then "blossoming" outwardly (FIG. 2) to form the wiping-swab 40. The container 14 can then be inverted from the position shown in FIG. 2, with the container 14 then being grasped to be used as a handle in cleansing the toilet seat area with the pre-moistened swab 40. By selecting a pad 12 of a square configuration, approximately 3¼ inches on a side, or of a circular configurations, 3¼ inches in diameter, a wiping-swab 40 of that same approximate 3¼ inch diameter is provided to then clean the toilet seat. In this configuration, the spaced ridges (or ribs) 22 provide an easy means of grasping the container—now usable as a handle—, and also can be fabricated to enhance the strength of the container 14. As will be seen, by employing a container 14 of a length 42 of some 3¼ inches, the disposable toilet seat wipe apparatus of the invention can be used to swab down the seat in a 3¼ inch swathe, and at a distance where the user's hand is spaced away from the seat by a comparable 3¼ inch, or so, height. The sanitizing of the seat will thus be seen to be as effective as the cleansing solution employed and the retention of that solution by the cleaning pad material, and by a simple wiping action carried out by the user from a readily displaced height.

FIG. 3 illustrates a cross-sectional view of the container 14, and illustrates an internal structure which operates to retain the central portion 26 of the pad 12 in place, in preventing the pad from being expelled by the upward movement of the plunger 30. In particular, two pairs of "protrusions" 50 and 58 are illustrated, as extending inwardly from the inside wall of the container 14. In this construction, reference numeral 52 identifies a flexible backing for the cleansing pad 12, preferably of a polymer/plastic/rubber compound of a type which is highly flexible yet capable of retaining or "memorizing" its desired final shape. Thus, if "folded" into the upward conical shape shown in FIG. 3, when pushed out the top of the container through the leaves 28, it then blossoms out to its "memorized" shape—which in the preferred embodiment of the invention, represents that of a circular, semi-rigid, flat backing for the pre-moistened cleansing portion shown as 56. Reference numeral 54, at the same time, serves as a stiffening portion of the flexible backing 52 which is contacted by the plunger in sliding the cleansing pad towards the leaves 28. In accordance with the construction of the protrusions 50 and 58, the base 54 is allowed to pass by the protrusions 58 as the plunger blossoms the pad 12 outwardly through the leaves 28, but the base is prevented from further movement by the protrusions 50. Once past the protrusions 58, however, such protrusions prevent the base 54 from sliding back down into the container 14 after the pad 12 has been deployed, so as to prevent the cleansing pad from thereafter coming loose. By virtue of the pad being originally folded into such upward conical shape, once the pad is thus forced through the leaves 28 (as in the manner shown in FIG. 2), the "blossoming-out" configuration of the swab is achieved.

While there have been described what are considered to be preferred embodiments of the present invention, it will be readily appreciated by those skilled in the art that modifications can be made without departing from the scope of the teachings herein. Thus, any materials can be substituted for the construction of the container 14 and plunger 30—as distinct from the plastic components of the preferred embodiment, any alternative dimensionings may be employed, and any cleansing pad materials or solutions may be utilized. As will additionally be appreciated, added rigidity may be afforded to the pad of the construction, where desired, through any appropriate backing, or stiffening member, flexible or otherwise, while still retaining the ability to "blossom" out during the wipe operation. For at least such reason, therefore, resort should be had to the claims appended hereto for a true understanding of the scope of the invention, and with an appreciation that for optimum "blossoming" of the pad 12 when opened and ready for use, the flexible, openable leaves (or closures) 28 should be equi-angularly disposed about the nib 24, as at 90° intervals, for example.

I claim:

1. A disposable toilet seat wipe, comprising:

a handle having first and second ends, an internal nib at said first end, and a plurality of flexibly displaceable closures at said first end, disposed about said nib;

a cleaning pad, pre-moistened with any of a germicidal sanitizing, disinfecting or similar like solution located within said handle;

a plunger insertable into said handle at said second end, said plunger being of a length to be upwardly movable within said handle to force portions of said pad outwardly through said flexibly displaceable closures;

a first protrusion positioned internally of said handle to limit the amount of said pad portions forced outwardly through said displaceable closures; and a second protrusion positioned internally of said handle to limit any tendency for the outwardly forced pad portions to revert back into said handle during use.

2. The disposable toilet seat wipe of claim 1 wherein substantially all of said cleaning pad is forced through said flexibly displaceable enclosures of said handle, except for such portion as continuing to be limited by said first protrusion.

3. The disposable toilet seat wipe of claim 1 wherein said cleaning pad, when opened, is of a circular configuration, approximately 3¼ inches in diameter.

4. The disposable toilet seat wipe of claim 1 wherein said flexibly displaceable closures are equi-angularly disposed about said nib.

5. The disposable toilet seat wipe of claim 1 wherein said handle is approximately 3 inches in length.

6. The disposable toilet seat wipe of claim 1 wherein also including a frangible container impervious to air and moisture, sealing said handle, said pad, and said plunger in a packaged configuration for easy storage.

7. The disposable toilet seat wipe of claim 6 wherein said frangible container comprises a foil-wrap envelope.

8. The disposable toilet seat wipe of claim 1 wherein said cleaning pad is composed of synthetic or natural fibers characterized by an ability to remain pre-moistened with any of said solutions over extended periods of time.

9. The disposable toilet seat wipe of claim 8 wherein said solution employed is characterized by an ability to quickly dry when exposed to ambient air.

10. The disposable toilet seat of claim 1 wherein said first protrusion is positioned internally of said handle between said nib and said second protrusion.

* * * * *